US005614360A

United States Patent [19]

Harbison et al.

[11] Patent Number: 5,614,360

[45] Date of Patent: Mar. 25, 1997

[54] PHOTOGRAPHIC ELEMENT AND COATING COMPOSITION

[75] Inventors: Kenneth G. Harbison, Rochester; Wilbur S. Gaugh, Webster; Thomas H. Whitesides; James A. Friday, both of Rochester, all of N.Y.

[73] Assignee: Eastman Kodak Company, Rochester, N.Y.

[21] Appl. No.: 357,474

[22] Filed: Dec. 16, 1994

[51] Int. Cl.[6] ..... G03C 1/34

[52] U.S. Cl. ..... 430/612; 430/539; 430/614; 430/640; 252/315.2; 396/6

[58] Field of Search ..... 430/607, 612, 430/615, 604, 539, 608, 605, 614, 640; 556/137; 252/315.2; 354/76

[56] References Cited

U.S. PATENT DOCUMENTS

| | | | |
|---|---|---|---|
| 2,448,060 | 7/1946 | Smith et al. | 430/604 |
| 2,472,627 | 6/1949 | Smith et al. | 430/608 |
| 2,552,229 | 5/1951 | Stauffer et al. | 430/612 |
| 2,566,245 | 8/1951 | Trivelli et al. | 430/608 |
| 2,598,079 | 5/1952 | Stauffer et al. | 95/7 |
| 4,242,430 | 12/1980 | Hara et al. | 430/559 |
| 4,623,615 | 11/1986 | Yokoyama et al. | 430/527 |
| 4,892,808 | 1/1990 | Harbison et al. | 430/517 |

FOREIGN PATENT DOCUMENTS

| | | |
|---|---|---|
| 0572022 | 12/1993 | European Pat. Off. . |
| 0578225A2 | 1/1994 | European Pat. Off. . |
| 0597312A1 | 5/1994 | European Pat. Off. . |
| 1157077 | 11/1963 | Germany . |
| 231431 | 12/1985 | Germany . |
| 244644 | 4/1987 | Germany . |
| 58-126529A | 7/1983 | Japan . |
| 59-24842 | 2/1984 | Japan . |
| 59-214848 | 12/1984 | Japan . |
| 60-70441 | 4/1985 | Japan . |
| 60-205539A | 10/1985 | Japan . |
| 131258 | 6/1987 | Japan . |
| 03-153235A | 7/1991 | Japan . |
| 148818 | 5/1994 | Japan . |
| 1644070A | 4/1991 | U.S.S.R. . |
| 1656491A1 | 6/1991 | U.S.S.R. . |
| 1656491 | 6/1991 | U.S.S.R. . |

*Primary Examiner*—Lee C. Wright
*Attorney, Agent, or Firm*—Peter C. Cody; Sarah Meeks Roberts

[57] ABSTRACT

A photographic element and an aqueous coating composition for providing a layer to a photographic element are disclosed. The coating composition comprises gelatin in a concentration greater than about 6% by weight, and a palladium complex having the structure:

(I)

wherein $R^1$, $R^2$, $R^3$, $R^4$, $R^5$, $R^6$, $R^7$, and $R^8$ are independently selected from hydrogen, alkyl, alkenyl, aryl or alkaryl, the alkyl, alkenyl, aryl, or alkaryl optionally being substituted with a hydroxy, sulfonate, amino or ammonium group; and wherein any two of $R^1$, $R^2$, $R^3$, $R^4$, $R^5$, $R^6$, $R^7$, and $R^8$ can be bonded to form a ring;

$Z^1$ and $Z^2$ independently represent the number of carbon atoms necessary to form a 5 or 6 membered ring, inclusive of palladium, wherein the carbon atoms may be substituted with hydrogen, sulfonate, alkyl, alkenyl, aryl or alkaryl, the alkyl, alkenyl, aryl, or alkaryl optionally being substituted with a hydroxy, halogen, sulfonate, amino or ammonium group; and n is −2 to 4.

18 Claims, 1 Drawing Sheet

PHOTOGRAPHIC ELEMENT AND COATING COMPOSITION

FIELD OF THE INVENTION

This invention relates to silver halide photographic elements and to coating compositions for the preparation thereof.

BACKGROUND OF THE INVENTION

It is known that in silver halide photographic elements, silver ions can be reduced to form metallic deposits of silver. When these deposits are unintended, such as when a camera containing the element leaks light thus exposing the element, or when physical pressure is applied to the element's emulsion layers by, for example, a component of a camera, then they are termed fog.

Fog can be formed locally or generally. Described above are two ways in which to form local fog. General fog, which occurs more or less uniformly across an entire element or emulsion layer, is typically formed in response to the ambient conditions in which the element is stored. For example, many photographic elements are susceptible to general fog formation and sensitivity loss when they are stored for an extended period of time in conditions of high temperature and humidity. General fog may also be formed by action of reducing agents contained in the photographic elements.

For more than forty years it has been known that certain palladium salts, when incorporated into a photographic emulsion, stabilize the emulsion and impart to it an increased resistance to fog formation and sensitivity loss. Palladium glycine complexes, in particular, have been known to control fog formation and sensitivity loss in photographic elements stored under tropical conditions. Accordingly, such palladium glycine complexes are utilized in many photographic silver halide materials currently commercialized.

Known palladium complexes are described in U.S. Pat. Nos. 2,598,079 and 4,892,808; Soviet Union Patent 1,656,491; European Patent Application 0 572 022; and German Patent 1,157,077. In U.S. Pat. No. 2,552,229, the sensitivity, gamma, and fog-inhibiting effects of a series of palladium complexes are explored.

Although many known and currently utilized palladium complexes are useful in solving the problem of fog formation and sensitivity loss as a result of prolonged storage in tropical conditions, use of these complexes provides the modern film builder with a whole range of additional unanticipated problems. As it turns out, when previously utilized palladium complexes are incorporated into an aqueous coating composition that is to be coated in a photographic element, the palladium complexes tend to interact with the gelatin of the coating composition. Such interaction is believed to be due to bonding of the palladium with amino and amide groups found in gelatin. The interaction forms reversible cross-links which leads to a rise in the viscosity of the coating composition.

The viscosity rise in aqueous coating compositions as a result of the interaction of palladium complexes with gelatin is acceptable to a limited degree. However, when excessive, it can lead to the formation of palladium gelatinate slugs; and the level of slug formation is directly related to the frequency of coating defects.

Filters are commonly used in an attempt to trap slugs. When numerous slugs are present, though, the pressure drop of the filter tends to rise as slugs accumulate on the filter.

This requires more frequent filter changes. In extreme cases, filters can become blocked by slugs, thus causing stoppage of the coating.

When slugs accumulate on a filter, there is also the possibility that some will be forced through the filter because of the influence of the higher pressure drop and fragmentation of the slugs as they age. If slugs are coated, they can cause a local change in the thickness of the coated layer, which consequently affects the thicknesses of adjacent layers. This, in turn, can impact the quality of the image reproduced in the photographic element.

In an effort to minimize the impact of slug formation on the quality of photographic elements, film builders have employed such techniques as splitting the palladium complex among multiple layers; maintaining emulsion melts at higher temperatures or for longer times so as to disperse the slugs; diluting the coating composition to reduce the gelatin and palladium concentrations, which can adversely affect drying and thereby coating speed; and filtering through on-line filters which, as described, need to be changed frequently to remove the slugs. Another technique used is to coat the palladium complex at a level below that which is optimal for stabilization.

Although attempts have been made to reduce the detrimental impact of palladium complexes, such attempts have proved inadequate and have resulted in photographic elements that are overly susceptible to fogging and/or slug formation. Accordingly, there exists a desire in the art to obtain the advantageous stabilizing and antifogging effects known to be achieved by use of certain palladium complexes, without obtaining the detrimental viscosity increasing effects that are also known to result from use of the same complexes.

SUMMARY OF THE INVENTION

In accordance with the present invention, there is provided an aqueous coating composition for providing a layer to a photographic element, the composition comprising gelatin in a concentration greater than about 6% by weight, and a palladium complex having the structure:

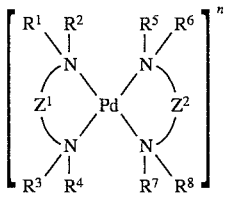

(I)

wherein $R^1$, $R^2$, $R^3$, $R^4$, $R^5$, $R^6$, $R^7$, and $R^8$ are independently selected from hydrogen, alkyl, alkenyl, aryl or alkaryl, the alkyl, alkenyl, aryl, or alkaryl optionally being substituted with a hydroxy, sulfonate, amino or ammonium group; and wherein any two of $R^1$, $R^2$, $R^3$, $R^4$, $R^5$, $R^6$, $R^7$, and $R^8$ can be bonded to form a ring;

$Z^1$ and $Z^2$ independently represent the number of carbon atoms necessary to form a 5 or 6 membered ring, inclusive of palladium, wherein the carbon atoms may be substituted with hydrogen, sulfonate, alkyl, alkenyl, aryl or alkaryl, the alkyl, alkenyl, aryl, or alkaryl optionally being substituted with a hydroxy, halogen, sulfonate, amino or ammonium group; and n is −2 to 4; and wherein the ratio of palladium complex to gelatin is from about $2.5\times10^{-2}$ to about $1.0\times10^{-4}$ mol palladium complex to 1000 grams of gelatin.

The aqueous coating composition provides a layer of a photographic element that imparts to the element a resistance to fogging and sensitivity loss, particularly when the element is subjected to tropical conditions of high temperature and humidity for an extended period of time. The aqueous coating composition is also such that it is not prone to viscosity rise and concurrent slug formation that typically accompanies the use of palladium complexes in gelatin containing solutions. Thus, the present invention provides a means by which to avoid the coating defects in many modern photographic elements.

The present invention also provides a photographic element that exhibits the above described resistance to fogging and sensitivity loss without a substantial and concurrent rise in viscosity or slug formation.

DETAILED DESCRIPTION OF THE INVENTION

Figure 1:
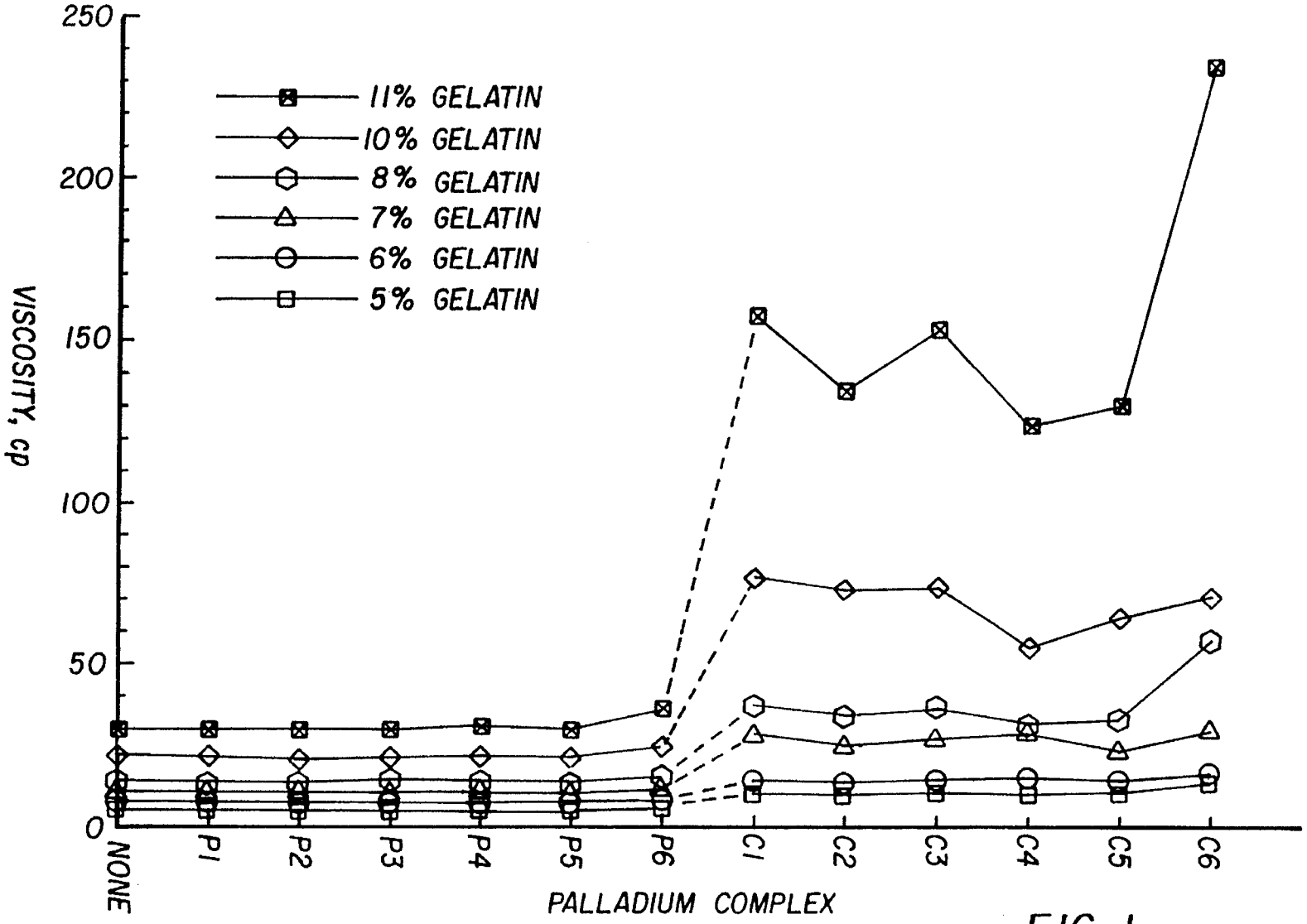
FIG. 1 is a graph showing the viscosity of a series of aqueous coating compositions containing different palladium complexes and varying gelatin concentrations.

Prior to the present invention, palladium complexes utilized in commercial photographic products suffered the disadvantage of reacting with the gelatin matrix of the coating composition in which they were contained. Such a disadvantage was tolerable in the past when coating compositions were made with relatively low gelatin concentrations because the rise in viscosity resulting from the palladium complex-gelatin interaction was mitigated by the fact that the coating compositions were inherently not very viscous. However, when elevated gelatin concentrations became prevalent (they are used in many modern products), it was found that the reaction of the palladium complexes and gelatin resulted in a substantial rise in the viscosity of the coating compositions, and ultimately the formation of an excess number of palladium gelatinate slugs. This problem has been made even more pronounced by the fact that the industry is presently trying to reduce photographic layer thicknesses so as to improve sharpness and other photographic characteristics. When the volume of the coating compositions is reduced, the concentration of palladium must consequently be increased to maintain the desired coverage of palladium; this results in an increase in the interaction between the palladium and the gelatin.

The present invention has overcome these problems by providing an aqueous coating composition for providing a layer to a photographic element, the coating composition having incorporated within it a specific type of palladium complex. When the aqueous coating composition is coated, the palladium complex imparts to the photographic element an increased stability and resistance to fogging, which many previously utilized palladium complexes were known to do; but it does so without a concurrent and deleterious rise in viscosity and slug formation. Specifically, the palladium complex utilized in the present invention has the structure:

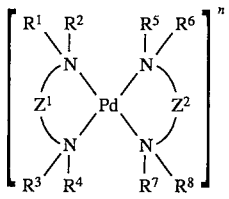

(I)

wherein $R^1$, $R^2$, $R^3$, $R^4$, $R^5$, $R^6$, $R^7$, and $R^8$ are independently selected from hydrogen, alkyl, alkenyl, aryl or alkaryl, the alkyl, alkenyl, aryl, or alkaryl optionally being substituted with a hydroxy, sulfonate, amino or ammonium group; and wherein any two of $R^1$, $R^2$, $R^3$, $R^4$, $R^5$, $R^6$, $R^7$, and $R^8$ can be bonded to form a ring;

$Z^1$ and $Z^2$ independently represent the number of carbon atoms necessary to form a 5 or 6 membered ring, inclusive of palladium, wherein the carbon atoms may be substituted with hydrogen, sulfonate, alkyl, alkenyl, aryl or alkaryl, the alkyl, alkenyl, aryl, or alkaryl optionally being substituted with a hydroxy, halogen, sulfonate, amino or ammonium group; and n is −2 to 4, preferably 2 or 4, and optimally 2.

In the palladium complex described above, the substituents represented by $R^1$, $R^2$, $R^3$, $R^4$, $R^5$, $R^6$, $R^7$, and $R^8$ can be bonded to one another in pairs to form one or more cyclic organic rings, preferably one or more 5 or 6 membered cyclic organic rings, or organometallic rings including the palladium atom. In this manner, it is contemplated $R^1$ and $R^3$ may be alkyl chains that are bonded to each other to form a cyclic organic ring, for instance a piperazine ring. Similarly, $R^1$ and $R^2$ may be alkyl chains that are bonded to each other to form an organic ring such as pyrrolidine or pyridine. Other combinations forming rings are also contemplated. For instance, $R^2$ and $R^5$ may be alkyl chains bonded together as in N,N'-bis(2-aminoethyl)-1,2-ethanediamine-N,N',N'',N''')palladium(2+)ion.

Suitable exemplary substituents satisfying $R^1$, $R^2$, $R^3$, $R^4$, $R^5$, $R^6$, $R^7$, and $R^8$ are the alkyl groups: methyl, ethyl, propyl, butyl, pentyl, hexyl, octyl, ethylhexyl, decyl, dodecyl, hexadecyl, octadecyl, isopropyl, and t-butyl; the alkenyl groups: propenyl, butenyl, pentenyl, hexenyl, and cyclohexenyl; the aryl groups: phenyl, tolyl, naphthyl, and pyridyl; and the alkaryl groups: benzyl and 2-phenylethyl. All such groups are capable of being substituted as described.

Suitable substituents on $Z^1$ and $Z^2$ are those described above with reference to $R^1$, $R^2$, $R^3$, $R^4$, $R^5$, $R^6$, $R^7$, and $R^8$. In particular, it is preferred that $Z^1$ and $Z^2$ independently represent the number of carbon atoms necessary to form an unsubstituted or alkyl substituted 5 or 6 membered ring.

In the present invention, the palladium complex preferably comprises palladium(II) as the palladium ion, and has a neutral, negative or positive charge. When it is an anion or cation, the palladium complex is typically incorporated into the aqueous coating composition in association with an anion(s) or cation(s) of sufficient charge to balance the charge of the complex. Halide ions, preferably chloride, or nitrate, sulfate, or acetate ions are normally utilized to balance the charge of the cationic palladium complex, although it is specifically contemplated that any ion(s) of sufficient balancing charge would be practical.

It is believed that in accordance with the invention, certain palladium complexes comprising palladium (IV) as the palladium ion will be converted to palladium (II) complexes when incorporated into a gelatin containing solution. This conversion is believed to be due to reduction of the palladium complex by components of the gelatin containing solution.

A preferred palladium complex suitable for use in the present invention has the structure:

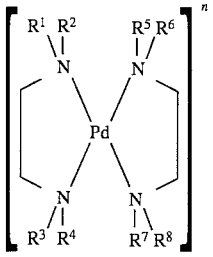

(II)

wherein $R^2$, $R^3$, $R^6$, and $R^7$ are hydrogen, and $R^1$, $R^4$, $R^5$, $R^8$, and n are as described as above. More preferably, $R^2$, $R^3$, $R^6$, and $R^7$ are hydrogen, and $R^1$, $R^4$, $R^5$, $R^8$ are selected from hydrogen or a substituted or unsubstituted lower alkyl having from 1 to 5 carbon atoms.

Specifically preferred palladium complexes, described in association with an appropriate anion(s), are

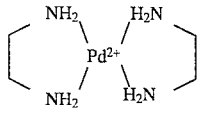

2X⁻

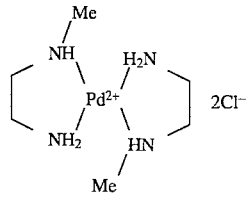

2Cl⁻

P-1: X = Cl
P-2: X = Acetate

P-3

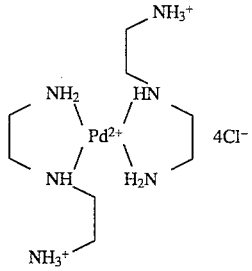

4Cl⁻

P-4

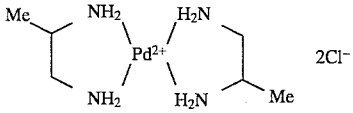

2Cl⁻

P-5

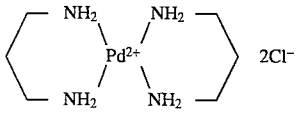

2Cl⁻

P-6

Additional compounds contemplated to be used in the present invention include: bis- (N, N-dimethyl-1,2 -ethanediamine-N,N')-palladium(2+)dichloride (P-7), bis-(N,N'-dimethyl-1,2-ethanediamine-N,N')-palladium(2+)-dichloride (P-8), bis-(N,N,N'-trimethyl-1,2-ethanediamine-N,N')-palladium(2+)dichloride (P-9), bis-(N,N,N',N'-tetramethyl-1,2-ethanediamine-N,N')-palladium(2+)-dichloride (P-10), bis-N,N'-(2-ammoniumethyl)-1,2-ethanediamine-N,N')-palladium(2+)tetrachloride (P-11), (N,N'-bis-(2-aminoethyl)-1,2-ethanediamine-N,N'N"N"")-palladium(2+)dichloride (P-12), and dibromo-bis-(1,2-ethanediamine-N,N') -palladium (IV) (2+)dibromide (P-13).

It is believed that some of the compounds described above are in equilibrium in the coating composition. An example is P-4 (bis (N-(2-ammoniumethyl)-1,2-ethanediamine-N, N')-palladium tetrachloride, which is believed to be in equilibrium with tri-coordinated diethylenetriamine complexes.

It is contemplated that with regard to the compounds described above, the particular counterion(s) specified is irrelevant and may be replaced by any suitable counterion(s). It is also contemplated that the isomers of the compounds described above are equally as suitable for the present invention.

In the most preferred embodiment of the invention, the palladium complex is a bis(1,2-ethanediamine-N,N') palladium(II) cation.

The palladium complexes of the invention are commercially available or can be readily synthesized by known methods from commercially available reactants. A specific synthesis of the preferred bis (1,2-ethanediamine-N,N') palladium dichloride consists of reacting dipotassium or diammonium tetrachloropalladate (1 mole) with 1,2-ethanediamine dihydrochloride (≧2 moles) and neutralizing rapidly to a pH of 7 with sodium hydroxide to form the compound of the invention. N. S. Kurakow and N. J. Gwosdaren Z. Anorg. Chem 22, 384 (1899) is incorporated herein by reference as describing an alternative synthesis of this complex.

The palladium complex is incorporated into a gelatin containing aqueous coating composition that contains a gelatin concentration of greater than about 6%, preferably greater than about 7%, more preferably greater than about 8%, and optimally greater than about 10%, by weight of the composition.

The palladium complex can be incorporated into the aqueous coating composition in a level sufficient to impart a stabilizing and antifogging effect to the photographic element. It is preferred that the level at which it is incorporated be such as to provide that the ratio of palladium complex to gelatin be from about $2.5\times10^{-2}$ to about $1.0\times10^{-4}$; more preferably from about $1.0\times10^{-3}$ to about $6.0\times10^{-3}$; and optimally from about $3.0\times10^{-3}$ to about $6.0\times10^{-3}$ mol palladium complex to 1000 grams of dry weight gelatin. At such ratios, the advantages inherent in the present invention are optimized for a photographic system.

Typically, the palladium complex will be incorporated into a photographic element at a level between about $8.0\times10^{-5}$ and about $4.0\times10^{-3}$ mol palladium complex per mol silver halide. More preferably, it is incorporated at a level between about $1.5\times10^{-4}$ and $4.0\times10^{-4}$ mol palladium complex per mol silver halide.

It is preferred that the coating composition of the present invention be coated as a non-image forming layer, for instance an overcoat layer, a subbing layer, an ultraviolet absorber layer, or an interlayer such as a yellow filter layer or scavenging layer for oxidized developer. It is also contemplated that the coating composition be coated as an image forming layer, for instance as an x-ray emulsion layer or as one of the layers of the blue sensitive, green sensitive, or red sensitive records of a color negative or color reversal film. If coated as an image forming layer, the coating composition, because it contains the palladium complex, can improve the sensitivity of the element.

The palladium complex employed in the present invention may be added to the aqueous coating composition at any time during the preparation of the photographic element or with any of the components of the photographic element. Preferably, it is incorporated by adding it to a gelatin solution during preparation of the melt for coating. It is also contemplated that it may be added as the aqueous coating composition is being delivered to the coating hopper.

In the present invention, the aqueous coating composition can contain any conventional gelatinous dispersing medium capable of being used in photographic emulsions. Specifically, it is contemplated that the gelatinous dispersing medium comprises an alkali treated gelatin (e.g., cattle bone and hide gelatin) or acid treated gelatin (e.g., pigskin gelatin) and gelatin derivatives—e.g., acylated gelatin, phthalated gelatin and diamine derivatized gelatin are specifically contemplated. Also contemplated are dispersing mediums comprised of carboxymethylcellulose, hydroxyethylcellulose, or synthetic vehicles such as polyvinyl alcohol and its derivatives, or acrylate polymers.

The aqueous coating composition of the present invention provides a layer of a photographic element by being applied by any conventional method for coating aqueous solutions, such as hopper or curtain coating, or direct or offset gravure. Drying of the composition can be done at any suitable temperature, preferably one between 32° and 77° C. Typically, the aqueous coating composition will be coated at a coverage of between about 0.15 $g/m^2$ to about 1.5 $g/m^2$, although other levels are also contemplated.

The aqueous coating composition may be incorporated into black-and-white, reversal, color negative or paper photographic elements containing any type of silver halide grains. These grains may be conventional in form such as cubes, octahedrons, or cubo-octahedrons, or they may be irregular such as spherical grains or tabular grains.

The photographic elements may be simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns.

In the following discussion of suitable materials for use in the aqueous coating compositions and elements of this invention, reference will be made to *Research Disclosure*, December 1978, Item 17643, and *Research Disclosure*, December 1989, Item No. 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures*. The elements of the invention can comprise emulsions and addenda described in these publications and publications referenced in these publications.

The aqueous coating composition can include any type of silver halide grains or it can be employed in photographic elements containing one or more silver halide emulsion layers that include any type of silver halide grains. Such grains can be comprised of silver bromide, silver chloride, silver iodide, silver bromochloride, silver iodochloride, silver iodobromide, silver iodobromochloride or mixtures thereof; and can be of any shape or size. Specifically, the emulsion layers can include coarse, medium or fine silver halide grains. Tabular grains having an aspect ratio greater than about 2, and more preferably greater than about 5, are specifically preferred for the layer(s), with high aspect ratio tabular grain emulsions such as those disclosed by Wilgus et al. U.S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference, specifically contemplated. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all of which are incorporated herein by reference.

The silver halide emulsion layers can be either monodisperse or polydisperse as precipitated. The grain size distribution of the emulsions can be controlled by silver halide grain separation techniques or by blending silver halide emulsions of differing grain sizes.

Dopants, such as compounds of copper, thallium, lead, bismuth, cadmium and Group VIII noble metals, can be present during process of the present invention or during preparation of silver halide grains employed in emulsion layers of the photographic element. Other dopants include transition metal complexes as described in U.S. Pat. Nos. 4,981,781, 4,937,180, and 4,933,272.

The emulsions prepared by the present invention can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent.

The silver halide grains of the emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure,* Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, styryls, merostyryls, and streptocyanines. Illustrative spectral sensitizing dyes are disclosed in *Research Disclosure,* Item 308119, cited above, Section IV.

Suitable vehicles for the emulsion layer and other layers of elements of this invention are described in *Research Disclosure,* Item 308119, Section IX and the publications cited therein.

The photographic elements can include couplers as described in *Research Disclosure,* Section VII, paragraphs D, E, F, and G and the publications cited therein. The couplers can be incorporated as described in *Research Disclosure,* Section VII, paragraph C, and the publications cited therein. Also contemplated are elements which further include image modifying couplers as described in *Research Disclosure,* Item 308119, Section VII, paragraph F.

The photographic elements can contain brighteners (Research Disclosure, Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), and those described in *Research Disclosure,* Section VI, anti stain agents and image dye stabilizers (*Research Disclosure,* Section VII, paragraphs I and J), light absorbing and scattering materials (*Research Disclosure,* Section VIII), hardeners (*Research Disclosure,* Section X), polyalkyleneoxide and other surfactants as described in U.S. Pat. No. 5,236,817, coating aids (*Research Disclosure,* Section XI), plasticizers and lubricants (*Research Disclosure,* Section XII), antistatic agents (*Research Disclosure,* Section XIII), matting agents (*Research Disclosure,* Section XII and XVI) and development modifiers (*Research Disclosure,* Section XXI.

The photographic emulsions can be coated on a variety of supports as described in *Research Disclosure,* Section XVII and the references described therein.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements, such as those disclosed in *Research Disclosure,* Vol. 184, August 1979, Item 18431 which is incorporated herein by reference.

The photographic elements are preferably exposed to actinic radiation, typically in the visible region of the spectrum, to form a latent image as described in *Research Disclosure,* Section XVIII, and then processed to form a visible black and white or dye image as described in *Research Disclosure,* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl -N-ethyl-N-(D-methanesulfonamidoethyl)-aniline sulfate hydrate, 4-amino-3-methyl-N-ethyl-N-(β-hydroxyethyl)-aniline sulfate, 4-amino-3-(β-methanesulfonamidoethyl)-N,N-diethylaniline hydrochloride, and 4-amino-N-ethyl-N-(β-methoxyethyl)-m-toluidine di-p-toluenesulfonic acid.

With negative-working silver halide emulsions, the processing step described above provides a negative image. The described elements can be processed in the known EP-2 or C-41 color process as described in, for example, the British Journal of Photography Annual, 1988, pages 196–198. To provide a positive (or reversal) image, the color development step can be preceded by development with a nonchromogenic developing agent to develop exposed silver halide, but not form dye, and then uniformly fogging the element to render unexposed silver halide developable. Reversal processing of the element of the invention is preferably done in accordance with the known E6 process as described and referenced in *Research Disclosure* paragraph XIX. Alternatively, a direct positive emulsion can be employed to obtain a positive image.

Development is followed by the conventional steps of bleaching, fixing, or bleach-fixing, to remove silver or silver halide, washing, and drying.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic material is exposed in a similar manner as any photographic materials are exposed in cameras, and then the product is sent to the developer who removes the photographic material and develops it. Return of the product to the consumer does not normally occur.

Single use cameras and their methods of manufacture and use are described in U.S. Pat. Nos. 4,801,957, 4,901,097,4,866,469, 4,849,325, 4,751,536, 4,827,298, European Patent Applications 0 460 400, 0 533 785, 0 537 908 and 0 578 225, all of which are incorporated herein by reference.

The invention can be better appreciated by reference to the following specific examples. They are intended to be illustrative and not exhaustive of the embodiments of the present invention.

EXAMPLES

The aqueous coating compositions of the present invention were compared to those containing no palladium complex or those containing comparative palladium complexes. Specifically, viscosity measurements as shown in Table I and FIG. 1 were made at varying gelatin concentration levels with a Rheometrics Fluids Spectrometer Model 8400™ with force rebalance transducer in steady shear mode with cone and plate geometry having a diameter of 50 mm and an angle of 0.02 radians. Measurements were made at 40° C. at a shear rate of 10 seconds$^{-1}$. All measurements were performed with an aqueous coating composition comprising standard gelatin in the concentration level specified, the composition having incorporated therein $6.0\times10^{-3}$ moles of palladium complex per 1000 grams of dry weight gelatin. To provide optimum surface tension of the coating composition, 0.2% by weight of a surfactant, specifically sulfobutandioic acid bis(2-ethylhexyl) ester sodium salt, was also incorporated.

Table I shows that for the palladium complexes of the invention, viscosity rise due to palladium-gelatin interaction is minimal relative to the control. By contrast, with coating compositions containing the comparative complexes, at gelatin concentrations greater than 6%, palladium gelatin interaction increases substantially, thus causing unacceptable increases in viscosity.

The data from Table I is set forth in graphical form in FIG. 1, which has along its x-axis the inventive and comparative palladium complexes. Along the y-axis, viscosity of the aqueous coating composition is shown in centipoise.

TABLE I

| | Viscosity[1] at | | | | | |
|---|---|---|---|---|---|---|
| Complex | 5% Gel[2] | 6% Gel[2] | 7% Gel[2] | 8% Gel[2] | 10% Gel[2] | 11% Gel[2] |
| None | 5.9 | 8.0 | 10.7 | 13.9 | 21.8 | 29.5 |
| P-1 | 5.7 | 7.4 | 10.4 | 13.3 | 21.3 | 29.6 |
| P-2 | 5.9 | 7.2 | 10.1 | 13.1 | 20.1 | 29.4 |
| P-3 | 5.7 | 7.2 | 10.1 | 14.4 | 21.1 | 29.6 |
| P-4 | 6.0 | 7.6 | 10.7 | 13.6 | 21.4 | 30.8 |
| P-5 | 5.7 | 7.3 | 10.0 | 12.9 | 20.7 | 29.6 |
| P-6 | 6.3 | 8.2 | 11.4 | 15.2 | 24.3 | 35.9 |
| C-1 | 10.2 | 13.9 | 28.0 | 37.0 | 76.7 | 157.2 |
| C-2 | 9.7 | 13.4 | 24.5 | 34.1 | 72.6 | 134.5 |
| C-3 | 10.8 | 14.4 | 26.8 | 36.5 | 73.6 | 153.1 |
| C-4 | 9.5 | 14.8 | 28.5 | 31.0 | 54.7 | 123.8 |
| C-5 | 10.6 | 13.8 | 22.7 | 32.8 | 63.8 | 129.9 |
| C-6 | 13.9 | 16.0 | 29.3 | 57.1 | 70.4 | 234.3 |

[1]Measured at 40° C. in terms of centipoise
[2]Gelatin concentration

The comparative palladium complexes utilized in the foregoing example as well as in subsequent examples include the palladium complexes of glycine (C-1), glutamic acid (C-2), and arginine (C-3). Each of these complexes is believed to be a mixture of components including structures S-1, S-2, and S-3, where R=H for glycine, R=$CH_2CH_2CO_2$— for glutamic acid and R=$CH_2CH_2CH_2NHC(=NH)NH_2$+for arginine.

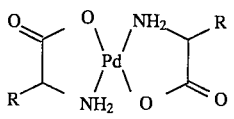
S-1

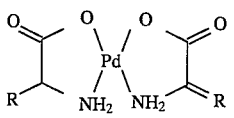
S-2

-continued

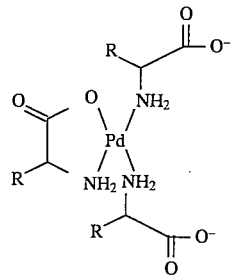
S-3

Other comparative complexes are diamminedichloropalladium (C-4), dichloro-bis-(pyridine)-palladium (C-5), tetramminepalladium(2+)dichloride (C-6), bis-(1,4-butanediamine-N,N')-palladium dichloride (C-7), ammonium tetrachloropalladate(2-) (C-8), diamminedibromopalladium (C-9), dichloro-bis-(ethaneamine)-palladium (C-10), dichloro-bis-(benzylamine)-palladium (C-11), and dichloro-bis-(quinoline)-palladium (C-12).

The invention was further explored by comparing the filterabilities of various coating compositions. Filterabilities of the aqueous coating compositions, as shown in Table II, were determined by collecting the coating composition solution which passed through a filter, in a beaker placed on a balance, and recording the weight automatically once every second. The filter was a Hollingswoth & Vose™ glass fiber membrane, Grade 20, held in a 47 mm Millipore™ filter holder. The gelatin solution was contained in a reservoir jacketed at 43.3° C. and maintained at a pressure of 5 psi.

The coating composition solution was prepared 30 minutes before measurement and was maintained at 43.3° C. with stirring. The time for 400 g to pass through the filter was determined from the record of weight versus time. A 10 minute filtering period was utilized. If fewer than 400 g passed through the filter in 10 minutes, the weight collected at 10 minutes was recorded and measurement was terminated.

The coating compositions and the levels of palladium complexes utilized in Table II were the same as those used for Table I. As can be seen from the results, the invention provides coating compositions that are easily filterable as compared to the comparative examples and, in some instance, even the example containing no palladium complex.

TABLE II

| Palladium Complex | Time (sec.) to 400 g. | Weight (at 10 min.) |
|---|---|---|
| None | 30.9 | >400 |
| P-1 | 30.3 | >400 |
| P-2 | 31.1 | >400 |
| P-3 | 32.1 | >400 |
| P-6 | 33.7 | >400 |
| P-7 | 36.4 | >400 |
| P-8 | 33.5 | >400 |
| P-9 | 34.5 | >400 |
| P-10 | 35.1 | >400 |
| P-11 | 29.4 | >400 |
| P-12 | 31.4 | >400 |
| P-13 | 28.7 | >400 |
| C-1 | >600 | 121 |
| C-2 | >600 | 85.3 |
| C-3 | >600 | 63.1 |
| C-4 | >600 | 8.7 |
| C-5 | >600 | 20.1 |
| C-6 | >600 | 16.4 |

TABLE II-continued

| Palladium Complex | Time (sec.) to 400 g. | Weight (at 10 min.) |
|---|---|---|
| C-7 | >600 | 52.5 |
| C-8 | >600 | 2.9 |
| C-9 | >600 | 7.0 |
| C-10 | >600 | 26.6 |
| C-11 | >600 | 47.7 |
| C-12 | >600 | 122.1 |

The palladium complexes utilized in the present invention, as indicated previously, impart to photographic elements improved stability when incorporated either into a non-image forming or image forming layer. These advantages are demonstrated below in Tables III and IV.

Exemplary aqueous coating compositions were coated in a photographic element and monitored for fog and sensitivity changes during storage. Specifically, color photographic elements having a blue sensitive silver chloride cubic emulsion, and red and green sensitive silver bromochloride cubic emulsions were prepared by methods known in the art. Bis-(1,2-ethanediamine-N,N')-palladium dichloride was incorporated into the aqueous coating compositions that formed each emulsion layer at 0.0012 mol per mol of silver. The elements were equilibrated to 50% relative humidity at 24° C. and then incubated at 49° C. for 1 week. Standard sensitometry measurements of the samples were made and compared with the sensitometry measurements of the same films stored at −18° C. As can be seen, ΔDmin (the increase or decrease in fog due to incubation) and ΔSpeed (the increase or decrease in speed due to incubation, measured at a density of 0.15 above Dmin), were improved when the palladium complexes of the invention were used. Also, the aqueous coating compositions of the invention suffered from little or no rise in viscosity as a result of palladium-gelatin interaction.

TABLE III

| | ΔDmin | | |
|---|---|---|---|
| Example | Red | Green | Blue |
| Control (no Pd) | 0.431 | 0.076 | 0.068 |
| P-1 | 0.000 | 0.000 | 0.010 |
| | ΔSpeed | | |
| Example | Red | Green | Blue |
| Control (no Pd) | −0.86 | −0.16 | −0.16 |
| P-1 | −0.00 | −0.01 | −0.04 |

In Table IV, the advantages of the invention are demonstrated in aqueous coating compositions that were incorporated into a non-image forming layer of a multilayer photographic element. The palladium complexes were coated in the interlayers of a silver iodobromide tabular grain emulsion (≦4.5% I). The interlayers were coated between the antihalation layer and the red-sensitive layers, and between the red-sensitive layers and the green sensitive layers. Incubation occurred for 4 weeks at 49° C. and 50% relative humidity. Sensitometry was measured as in Table III. As can be seen from the results, the palladium complexes utilized in the present invention generally provide the greatest degree of protection against of fog increase and sensitivity change.

TABLE IV

| | Pd level | ΔMin | | |
|---|---|---|---|---|
| Example | (mol/mol Ag) | Red | Green | Blue |
| Control (no Pd) | 0 | 0.187 | 0.182 | 0.062 |
| C-1* | $2.0 \times 10^{-4}$ | 0.069 | 0.069 | 0.027 |
| P-1 | $2.0 \times 10^{-4}$ | 0.062 | 0.067 | 0.031 |
| C-1* | $3.0 \times 10^{-4}$ | 0.069 | 0.077 | 0.043 |
| P-1 | $3.0 \times 10^{-4}$ | 0.059 | 0.060 | 0.028 |
| | Pd level | ΔSpeed | | |
| Example | (mol/mol Ag) | Red | Green | Blue |
| Control (no Pd) | 0 | −0.312 | −0.402 | −0.223 |
| C-1* | $2.0 \times 10^{-4}$ | −0.059 | −0.073 | −0.112 |
| P-1 | $2.0 \times 10^{-4}$ | −0.025 | −0.048 | −0.052 |
| C-1* | $3.0 \times 10^{-4}$ | −0.047 | −0.075 | −0.096 |
| P-1 | $3.0 \times 10^{-4}$ | −0.004 | −0.027 | −0.040 |

*Prepared from ammonium tetrachloropalladate and thus contains palladium-glycine complex impurities.

The invention has been described in detail with particular reference to preferred embodiments thereof, but it will be understood that variations and modifications can be effected within the spirit and scope of the invention.

What is claimed is:

1. An aqueous coating composition for providing a layer to a photographic element, said composition comprising gelatin in a concentration greater than about 6% by weight, and a palladium complex having the structure:

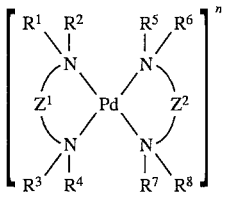

(I)

wherein $R^1$, $R^2$, $R^3$, $R^4$, $R^5$, $R^6$, $R^7$, and $R^8$ are independently selected from hydrogen, or alkyl, alkenyl, aryl or alkaryl groups, wherein the alkyl, alkenyl, aryl, or alkaryl groups may be unsubstituted or substituted with a hydroxy, sulfonate, amino or ammonium group; and wherein any two of $R^1$, $R^2$, $R^3$, $R^4$, $R^5$, $R^6$, $R^7$, and $R^8$ can be bonded to form a ring;

$Z^1$ and $Z^2$ independently represent the number of carbon atoms necessary to form a 5 or 6 membered ring, inclusive of palladium, wherein the carbon atoms may be substituted with hydrogen, sulfonate, alkyl, alkenyl, aryl or alkaryl groups, wherein the alkyl, alkenyl, aryl, or alkaryl groups are unsubstituted or substituted with a hydroxy, halogen, sulfonate, amino or ammonium group; and n is −2 to 4; and wherein the ratio of palladium complex to gelatin is from about $2.5\times10^{-2}$ to about $1.0\times10^{-4}$ mol palladium complex to 1000 grams of gelatin.

2. An aqueous coating composition according to claim 1 wherein the gelatin concentration is greater than about 7% by weight.

3. An aqueous coating composition according to claim 2 wherein the gelatin concentration is greater than about 8% by weight.

4. An aqueous coating composition according to claim 3 wherein the composition provides a non-image-forming layer.

5. An aqueous coating composition according to claim 3 wherein the composition provides an image-forming layer.

6. An aqueous coating composition according to claim 3 wherein the ratio of palladium complex to gelatin is from about $1.0\times10^{-3}$ to about $6.0\times10^{-3}$ mol palladium complex to 1000 grams of gelatin.

7. An aqueous coating composition according to claim 6 wherein the ratio of palladium complex to gelatin is from about $3.0\times10^{-3}$ to about $6.0\times10^{-3}$ mol palladium complex to 1000 grams of gelatin.

8. An aqueous coating composition according to claim 3 wherein the palladium complex has the structure:

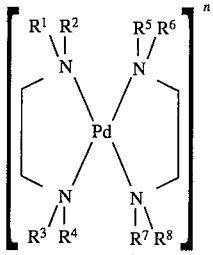

(II)

wherein $R^2$, $R^3$, $R^6$, and $R^7$ are hydrogen, and $R^1$, $R^4$, $R^5$, $R^8$, and n are as described in claim 1.

9. An aqueous coating composition according to claim 8 wherein $R^1$, $R^4$, $R^5$, $R^8$ are independently selected from hydrogen or an unsubstituted or hydroxy, sulfonate, amino or ammonium substituted lower alkyl having from 1 to 5 carbon atoms.

10. An aqueous coating composition according to claim 3 wherein the palladium complex is a bis (1,2-ethanediamine-N,N') palladium(II) cation.

11. An aqueous coating composition according to claim 3 wherein the photographic element further comprises a silver halide containing emulsion layer wherein emulsion layer contains tabular silver halide grains having an aspect ratio greater than about 2.

12. A photographic element comprising a support having coated thereon a layer formed from a gelatin containing solution having a gelatin concentration greater than about 6% by weight, wherein the layer comprises a palladium complex in an amount from about $2.5\times10^{-2}$ to about $1.0\times10^{-4}$ mol per 1000 grams of gelatin, and wherein the palladium complex has the structure:

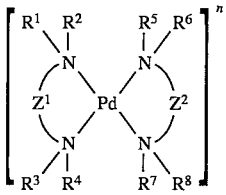

(I)

where $R^1$, $R^2$, $R^3$, $R^4$, $R^5$, $R^6$, $R^7$, and $R^8$ are independently selected from hydrogen, or alkyl, alkenyl, aryl or alkaryl groups, wherein the alkyl, alkenyl, aryl, or alkaryl groups may be unsubstituted or substituted with a hydroxy, sulfonate, amino or ammonium group;

$Z^1$ and $Z^2$ independently represent the number of carbon atoms necessary to form a 5 or 6 membered ring, inclusive of palladium, wherein the carbon atoms may be substituted with hydrogen, sulfonate, alkyl, alkenyl, aryl or alkaryl groups, wherein the alkyl, alkenyl, aryl, or alkaryl groups are unsubstituted or substituted with a hydroxy, halogen, sulfonate, amino or ammonium group; and n is −2 to 4.

13. A photographic element according to claim 12 wherein the palladium complex has the structure:

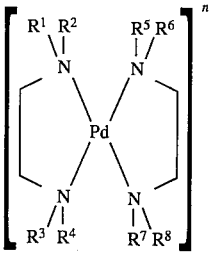

(II)

wherein $R^2$, $R^3$, $R^6$, and $R^7$ are hydrogen, and $R^1$, $R^4$, $R^5$, $R^8$ and n are as described in claim 1.

14. A photographic element according to claim 13 wherein $R^1$, $R^4$, $R^5$, $R^8$ are independently selected from hydrogen or an unsubstituted or hydroxy, sulfonate, amino or ammonium substituted lower alkyl having from 1 to 5 carbon atoms.

15. A photographic element according to claim 14 wherein the layer is formed from a gelatin containing solution having a gelatin concentration greater than about 7% by weight, and the ratio of palladium complex to gelatin is from about $1.0\times10^{-3}$ to about $6.0\times10^{-3}$ mol palladium complex to 1000 grams of gelatin.

16. A photographic element according to claim 15 wherein the layer is formed from a gelatin containing solution having a gelatin concentration greater than about 8% by weight, and the ratio of palladium complex to gelatin is from about $3.0\times10^{-3}$ to about $6.0\times10^{-3}$ mol palladium complex to 1000 grams of gelatin.

17. A photographic element according to claim 12 wherein the layer further comprises tabular grains.

18. A single use camera having incorporated therein a photographic element according to claim 12.

* * * * *